United States Patent [19]

Sharkey

[11] 4,324,534

[45] Apr. 13, 1982

[54] POWER SUPPLY APPARATUS

[75] Inventor: Robert L. Sharkey, Paisley, England

[73] Assignee: Andrew Master Hones Limited, Paisley, England

[21] Appl. No.: 189,833

[22] PCT Filed: May 29, 1979

[86] PCT No.: PCT/GB79/00086

§ 371 Date: Jan. 26, 1980

§ 102(e) Date: Jan. 23, 1980

[87] PCT Pub. No.: WO79/01136

PCT Pub. Date: Dec. 27, 1979

[30] Foreign Application Priority Data

May 26, 1978 [GB] United Kingdom ..... 23266/78

[51] Int. Cl.[3] ..... F04B 49/00

[52] U.S. Cl. ..... 417/414; 417/421

[58] Field of Search ..... 417/414, 421

[56] References Cited

U.S. PATENT DOCUMENTS

| | | | |
|---|---|---|---|
| 1,736,002 | 11/1929 | Frickey et al. | 417/421 X |
| 2,911,919 | 11/1959 | Tucker | 417/414 |
| 3,075,469 | 1/1963 | Lane, Jr. | 417/414 |
| 3,764,233 | 10/1973 | Strickland | 417/414 |
| 3,976,124 | 8/1976 | Brown | 60/456 X |

*Primary Examiner*—Leonard E. Smith

*Attorney, Agent, or Firm*—Auslander, Thomas & Morrison

[57] ABSTRACT

Power supply apparatus having a two part housing, the first part containing a motor in a gas environment and the second part containing a pump in a pressurized fluid environment, the second part having an inlet and outlet for passage of pressurized fluid to and from a tool to be driven by means of the pressurized fluid, the apparatus being of particular use under water, wherein pressure-equalizing means is provided for adjusting the pressure in both parts of the housing simultaneously in response to changes in ambient pressure outside the housing.

7 Claims, 1 Drawing Figure

POWER SUPPLY APPARATUS

Figure 1:
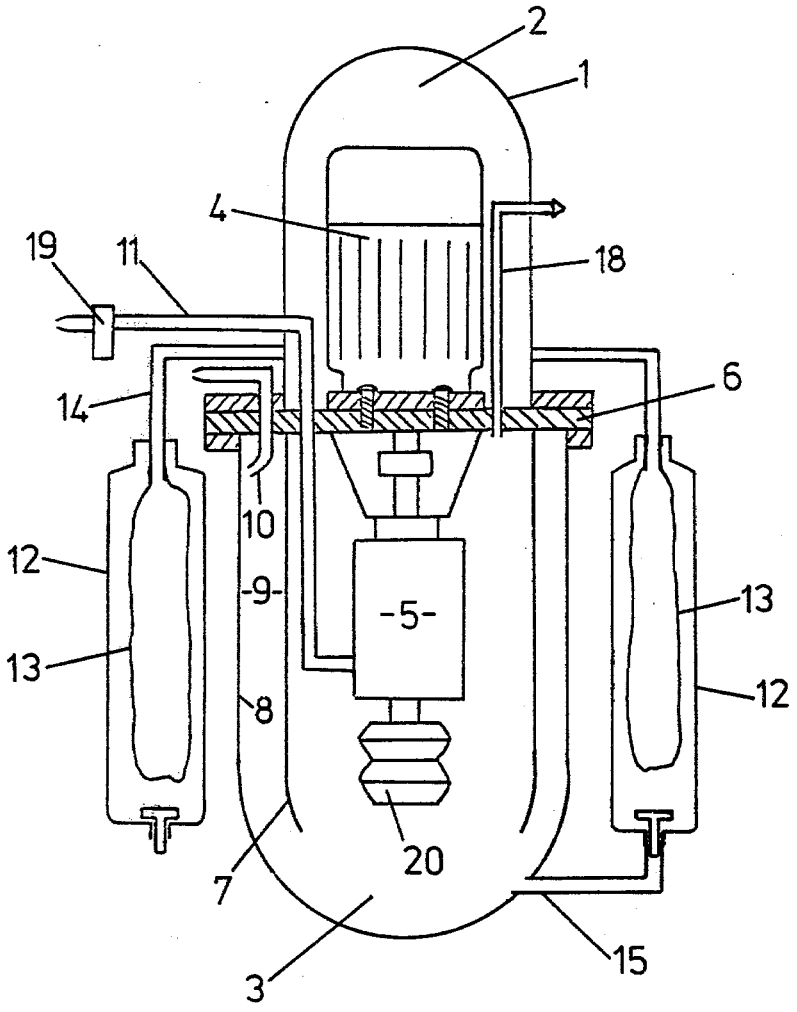

This invention relates to power supply apparatus.

In underwater environments there is often a considerable amount of heavy work to be done, and were this work to be done on land there would be a large range of hydraulic or pneumatic power tools available. There are problems, however, in working below the surface, and these problems multiply as the depth increases. For example, if the power source for the hydraulics is situated at the surface it is necessary to drop cables or the like to transfer the power to a diver, and this can be dangerous should the cable become entangled on some underwater obstruction; it is also inefficient as pressure loss occurs along the cable.

Because of the potential dangers in using hydraulic or pneumatic power tools supplied from the surface divers are generally wary of using them and heavy underwater work is often undertaken as a result using only improved hand tools such as hammers and chisels. This is obviously very inefficient, and as the cost involved in keeping a diver underwater is extremely high such methods are undesirable.

An object of this invention is to obviate or mitigate the above disadvantage hitherto associated with the underwater use of these power tools.

According to the present invention there is provided power supply apparatus comprising a housing which has a gas-containing portion in which is disposed a motor and a pressurised fluid-containing portion in which is disposed a pump, the pump being drivably connected with the motor, and inlet and outlet means in the housing wall to allow throughflow of pressurised fluid.

The pressure fluid may be hydraulic fluid or pressurised gas for pneumatic application.

The apparatus of this invention is of especial but not exclusive application in underwater environments for hydraulic power tools, in which case it is preferable that the gas-containing portion of the housing be isolated from the hydraulic fluid-containing portion in order that high pressures which prevail at great depths will not cause saturation of the gas in the hydraulic fluid. When the apparatus is for use at atmospheric pressure the two portions of the housing may intercommunicate, although it is preferable that means for preventing formation of gas bubbles and their passage into the hydraulic fluid should be included; a suitable means for this purpose is a perforate baffle plate on which bubbles can be trapped.

For operation of the apparatus at elevated pressure, such as on the sea bed, pressure equalising apparatus is included. This may for example be in the form of an accumulator which is open to the effect of external pressure with concomitant increase or decrease in the amount of gas supplied to the gas-containing portion of the housing from the accumulator; if, therefore, the apparatus of the invention is operating at high pressure on the sea bed, the ambient water pressure will cause the accumultor to expel an amount of gas into the housing sufficient to generate in the gas-containing portion of the housing a pressure equal to the water pressure. This allows the external walling of the gas-containing portion of the housing to be of minimum thickness as equal pressure is always present in either side of the walling. More than one accumulator can be used if the external pressure is sufficiently high to warrant it.

The gas in the housing is recommended to be inert, particularly with respect to ignition and support of combustion; a suitable gas is nitrogen.

It is preferable that the pressurised fluid-containing portion of the housing should have means for permitting cooling of fluid passing therethrough, and such means may be in the form of an inner walling of the housing extending part of the way through the pressurised fluid-containing portion so as to provide a passageway, for example annular, for flow of fluid from the inlet means to the pump. Preferably, the inlet means is disposed at an upper end of the pressurised fluid-containing portion and the passageway opens into the central part of that portion at its lower end. Preferably also the inlet means is disposed in such a way that fluid entering the housing therefrom undergoes motion in a vortex around the perimeter of the housing, whereby heat exchange through an outer walling of the housing can take place to cool the fluid.

The motor in the gas-containing portion of the housing is preferably an electric motor, and it may be powered by battery or by external power source. When the apparatus is for use underwater it is preferable that the power source be batteries supplied on the apparatus thereby obviating the need for power cables extending from the surface to the apparatus.

An embodiment of the invention will now be described by way of example with reference to the accompanying drawing, in which:

FIG. 1 is a section through apparatus of this invention.

The apparatus of this embodiment has a steel housing 1 which is generally cylindrical with domed ends. The interior of the housing 1 is divided by a plate 6 into mutually-isolated upper and lower chambers 2 and 3 containing nitrogen and hydraulic fluid respectively. The nitrogen-containing chamber 2 houses an electric motor 4 which is powered by batteries (not shown) contained in the housing 1, and the motor 4 is drivably connected with a hydraulic pump 5 in the fluid-containing chamber 3. The walls of the chamber 2 are finned for maximum cooling. The connection between the motor 4 and the pump 5 is sealed where it passes through the plate 6 so as to prevent interpassage between the nitrogen and the hydraulic fluid.

The lower chamber 3 has a steel skirt 7 in it to define with housing walling 8 an annular passageway 9. The skirt 7 terminates short of the lower end walling of the housing 1. A magnetic screen filter 20 is provided in the lower chamber 3 to trap any metal particles and prevent them entering and damaging the pump 5.

An inlet 10 is provided for the lower chamber 3, being disposed in such a way that fluid entering the housing 1 therethrough is subjected to a downward helical motion along and around the passageway 9. An outlet 11 is also provided for the lower chamber 3, and the inlet 10 and outlet 11 form part of the return and pressure lines respectively for the pump 5, between which hydraulically-driven equipment can be fitted. A filter 19 is provided in the pressure line so as to be replaceable without dismantling the housing 1 and a magnetic screen filter 20 is provided at the inlet of the pump 3.

The present embodiment of the invention is designed specifically for undersea use with high external pressures being experienced, and to allow for this a series of hydraulic accumulators 12 is provided, each being secured externally to the housing walling 8. The accumulators 12 are interconnected and all but one are open at their lower ends. Each accumulator 12 contains a rubber bag 13 which is filled with nitrogen and whose interior communicates with the upper chamber 2 of the housing 1 through a gas line 14. Thus when ambient pressure increases the bag 13 is compressed, forcing nitrogen along the gas line 14 until the pressure in the upper chamber 2 is equal to ambient temperature.

The final accumulator 12 in the series is closed to the external environment and communicates through a line 15 with the lower chamber 3 thereby to exert a pressure on the hydraulic fluid in the chamber 3 equal to ambient pressure and to compensate for any sudden pressure differences between the pressure and return lines.

A support in the form of round-section bar can be provided connected to the plate 6 through a collar, the support providing a frame for containing the housing 1 when on the sea bed. The bar preferably has holes through it and these, along with the round form of the bar, minimise the likelihood of the apparatus becoming stuck in mud or the like on the sea bed.

A bleeder line 18 is provided from the lower chamber 3 for filling the chamber with fluid, this line 18 being sealed prior to submersion of the apparatus in the sea. A pressure sensor (not shown) is provided for sensing the load on the pump 5 continuously and for regulating the flow through the pump 5 accordingly.

When the apparatus is to be used it has its lower chamber 3 filled with hydraulic fluid and its upper chamber 2 filled with nitrogen, and is then lowered into the sea. The provision of the accumulators 12 for equalising the external and internal pressures continuously allows the housing walling 8 to be made of relatively thin material, thus keeping the weight of the apparatus down; this is also helped by the presence of the nitrogen in the upper chamber 2. As the apparatus is lowered, its attitude remains substantially constant because of the weight differential between the upper and lower chambers 2 and 3; the fluid in the lower chamber 3 acts as a ballast, keeping the housing 1 upright.

Once rested on the sea bed, or suspended in the water by a line attached to shackle connectors on the housing 1, the inlet 10 and outlet 11 are connected by hydraulic lines to equipment to be driven, and the motor 4 is actuated, driving the pump 5. This causes hydraulic fluid to be expelled through the outlet 11 into the pressure line, the fluid returning along the return line into the inlet 10, and upon re-entering the housing 1 it undergoes a helical swirling motion along the passageway 9, thereby frequently contacting the housing walling 8 and being cooled by heat exchange through the walling 8 with the sea water. On emerging from the lower end of the passageway 9, the fluid is again drawn into the pump 5 for recirculation.

The apparatus of this embodiment of the invention is light in weight because of the absence of thick metal walls to withstand the external water pressure and because of the presence of the nitrogen in the upper chamber 2, provides efficient cooling for the hydraulic fluid in use with maximum utilisation of the quantity of fluid present, and can be used at extreme depths without fear of damage to the housing 1 due to the external water pressure. Extra accumulators 12 can be added to the series provided if extremely high pressures are to be encountered, in oder to provide enough nitrogen to pressurise the housing 1 interior to the ambient pressure, but it has been found that five accumulators 12 will be sufficient for depths of up to 1200 feet.

The apparatus of this embodiment can provide in situ power for underwater equipment thereby eliminating or reducing the amount of "loss" experienced when such equipment is powered by apparatus at the surface and connected thereto by hydraulic lines.

The apparatus of this embodiment is suitable for providing about 20 hp to drive underwater equipment, and can also be used in land-based environments which may or may not be at elevated pressure. The apparatus of the embodiment described can be assembled from currently-available component parts which can be slightly modified if required.

The apparatus can be dismantled from the support means and secured to a corresponding mounting on, for example, a diving bell or the like, so is easily adaptable for use on many underwater devices.

Improvements and modifications can be made without departing from the scope of the invention. For example, the upper and lower chambers 2, 3 the plate 6 and the collar 21 of the support may be clamped together, with seals between them, by an annular clamp having a tapered inner surface corresponding to a taper on the chamber 2, 3 flanges, the clamp being in two hinged portions and securable by an over-centre catch which may be subsequently secured by a bolt or the like.

I claim:

1. Power supply apparatus having
a housing having an external wall,
a gas-containing chamber in the housing,
a motor in said gas-containing chamber,
a fluid-containing chamber in the housing, the fluid being different from said gas,
a pump in said fluid-containing chamber for pressurizing said fluid,
said pump being drivably connected to said motor,
inlet and outlet means for said fluid-containing chamber and extending through the housing wall,
pressure-equalizing means for altering the pressure of said gas in said gas-containing chamber and of said fluid in said fluid-containing chamber in response to changes in ambient pressure external of the housing,
said pressure-equalizing means comprising a plurality of deformable gas-filled containers external of the housing in gas flow communication with each other and with said gas-containing chamber of the housing,
at least two of said containers being exposed externally to said ambient pressure and
at least one other of said containers being exposed externally to said fluid in said fluid-containing chamber of the housing.

2. Apparatus according to claim 1, wherein the containers are each disposed within a respective cover all but one of which are open to allow exposure of their containers to said ambient pressure, the other cover forming a barrier against exposure of its container to said ambient pressure and being in fluid flow communication with said fluid-containing chamber of the housing.

3. Apparatus according to claim 1 or 2, wherein the containers are flexible bags.

4. Apparatus according to claim 1 or 2, wherein the fluid is hydraulic fluid.

5. Apparatus according to claim 1 or 2, wherein the gas is nitrogen.

6. Apparatus according to claim 1 or 2, wherein means is provided for use in cooling the fluid, the means being walling spaced from the external wall of the housing to define a passageway adjacent the inlet through the housing wall thereby to constrain incoming fluid in a path adjacent the housing external wall.

7. Apparatus according to claim 1 or 2, wherein the motor is a battery-powered electric motor.

* * * * *